US007201449B2

(12) United States Patent
Tsai

(10) Patent No.: US 7,201,449 B2
(45) Date of Patent: Apr. 10, 2007

(54) MULTIPLE DIRECTION ADJUSTMENT ARMREST

(75) Inventor: Ching Tao Tsai, Taipei (TW)

(73) Assignee: Fusco Industrial Corporation, Taipei (TW)

( * ) Notice: Subject to any disclaimer, the term of this patent is extended or adjusted under 35 U.S.C. 154(b) by 176 days.

(21) Appl. No.: 11/121,550

(22) Filed: May 4, 2005

(65) Prior Publication Data

US 2006/0250018 A1 Nov. 9, 2006

(51) Int. Cl.
*A47C 7/54* (2006.01)

(52) U.S. Cl. ..... 297/411.36; 297/411.37; 297/411.38

(58) Field of Classification Search ..... 297/115, 297/411.2, 411.35, 411.36, 411.37, 411.38
See application file for complete search history.

(56) References Cited

U.S. PATENT DOCUMENTS 5,318,347 A * 6/1994 Tseng ..... 297/411.36
5,368,365 A * 11/1994 Feldberg ..... 297/411.36
5,435,626 A * 7/1995 Lai ..... 297/411.36
5,641,203 A * 6/1997 Van De Riet et al. .. 297/411.37
5,895,095 A * 4/1999 Chen ..... 297/411.36
5,971,484 A * 10/1999 Lamart et al. ..... 297/411.37
6,017,091 A * 1/2000 Cao ..... 297/411.37
6,062,647 A * 5/2000 Mei ..... 297/411.36
6,168,237 B1 * 1/2001 Lamart et al. ..... 297/411.37
6,502,904 B1 * 1/2003 Hansen ..... 297/411.35
6,619,746 B2 * 9/2003 Roslund et al. ..... 297/411.36
6,799,803 B1 * 10/2004 Lee et al. ..... 297/411.35
6,837,545 B1 * 1/2005 Ho ..... 297/411.36
6,896,333 B1 * 5/2005 Matern et al. ..... 297/411.36
6,948,775 B2 * 9/2005 Tsai ..... 297/411.37
6,974,189 B2 * 12/2005 Machael et al. ..... 297/411.36
2003/0030317 A1 * 2/2003 Chen ..... 297/411.35

* cited by examiner

*Primary Examiner*—Joseph Edell

(57) ABSTRACT

An adjustable armrest includes an elevation device to allow adjustment of a height of the armrest, a first rocking device to allow adjustment of the armrest to the left or to the right, a movement controlling device to allow front and rear adjustment of the armrest and a second rocking device to allow movement of the armrest.

10 Claims, 16 Drawing Sheets

MULTIPLE DIRECTION ADJUSTMENT ARMREST

BACKGROUND OF THE INVENTION

1. Field of the Invention

The present invention relates to an armrest, and more particularly to an armrest that is adjustable in different directions.

2. Description of Related Art

The currently available armrests can be adjusted to adapt to the user's preference. That is, the armrest's height can be adjusted or the armrest's left or right movement distance can be adjusted so as to cope with users of different height. However, the armrests can only provide adjustment in two dimensions, none of the armrests are able to provide adjustment in multiple dimensions.

To overcome the shortcoming the conventional armrest has, the present invention is to provide an improved armrest that can be adjusted in multiple directions such that users of different height are able to use the armrest comfortably.

SUMMARY OF THE INVENTION

The primary objective of the present invention is to provide an improved armrest in which height, distance, and relative angle between two armrests can be adjusted.

In order to accomplish the aforementioned objective, the armrest of the present invention is provided with an elevation device to control the elevation of the armrest, a first rocking device to control lateral movement of the armrest, a movement controlling device to control the front and rear movement of the armrest and a second rocking device sandwiched between the first rocking device and the movement controlling device. The movement controlling device is provided with an armrest cover to adapt users of different arm length. The first rocking device is located between the elevation device and the movement controlling device to adjust distance between two armrests. The second rocking device is able to adjust an angle between two armrests so that the user is able to comfortably rest his/her arms.

Other objects, advantages, and novel features of the invention will become more apparent from the following detailed description when taken in conjunction with the accompanying drawings.

DETAILED DESCRIPTION OF PREFERRED EMBODIMENT

Figure 1:
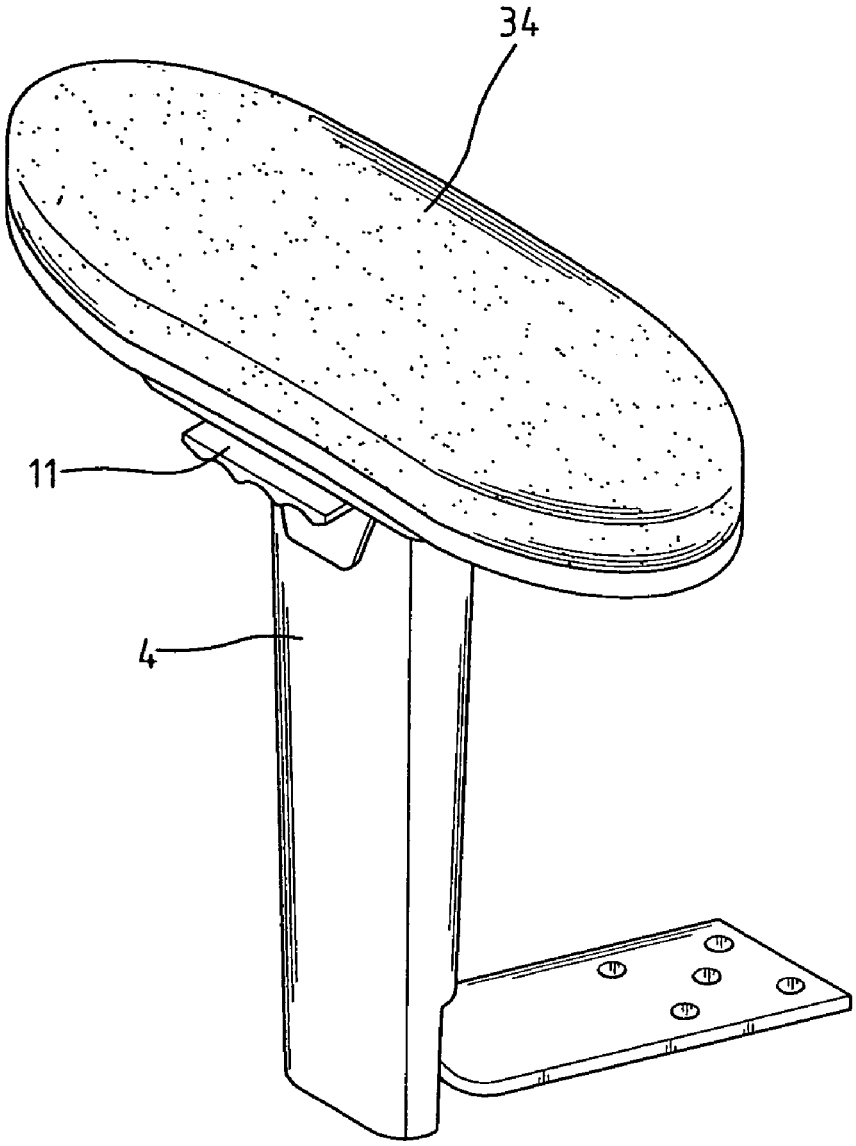
FIG. 1 is a perspective view of an armrest constructed in accordance with the present invention.
Figure 2:
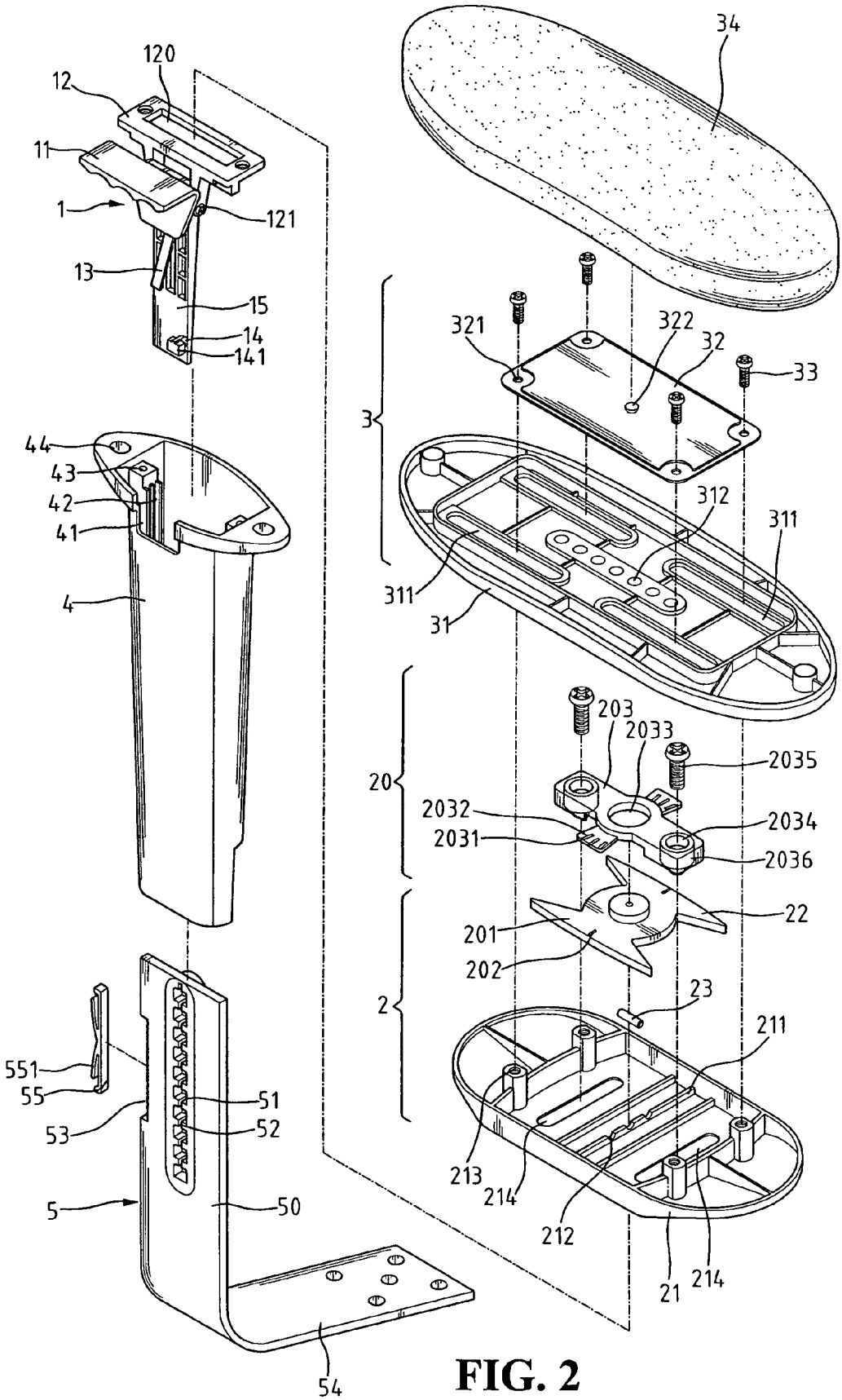
FIG. 2 is an exploded perspective view of the armrest shown in FIG. 1.

With reference to FIGS. 1 and 2, it is noted that the armrest in accordance with the present invention includes an elevation device 1, a first rocking device 2, a movement controlling device 3 and a second rocking device 20.

Figure 10:
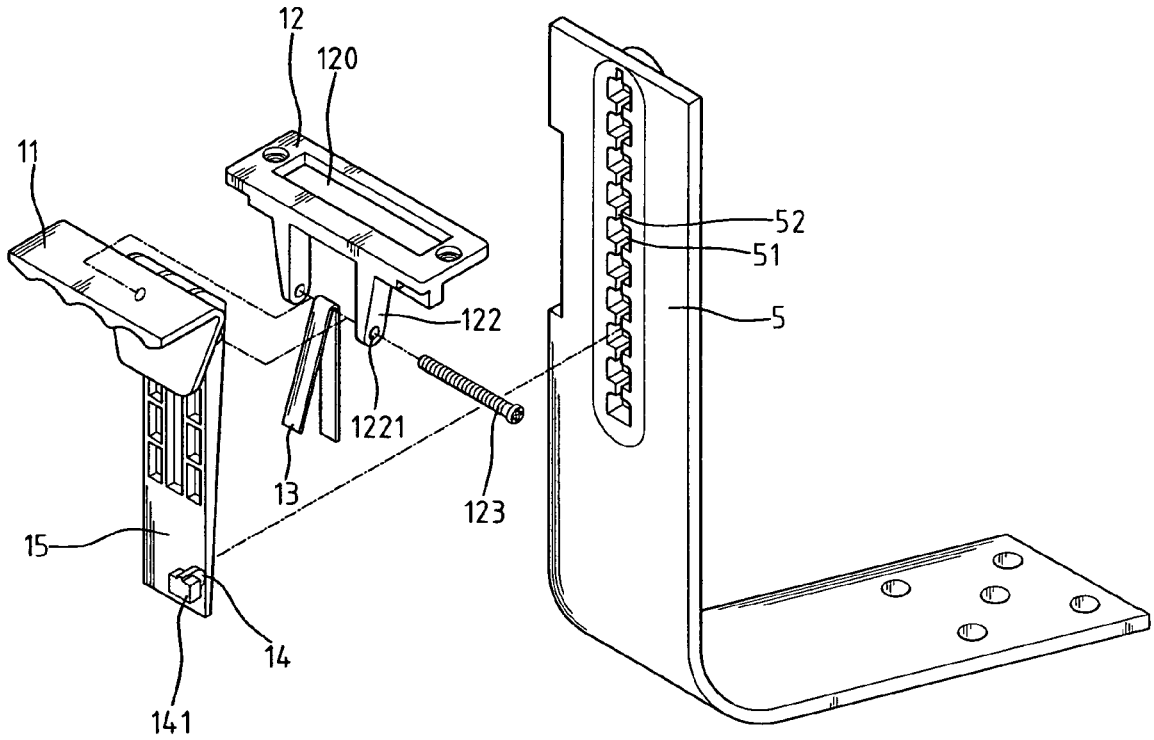
FIG. 10 is an exploded perspective view of an elevation device of the present invention.
Figure 11:
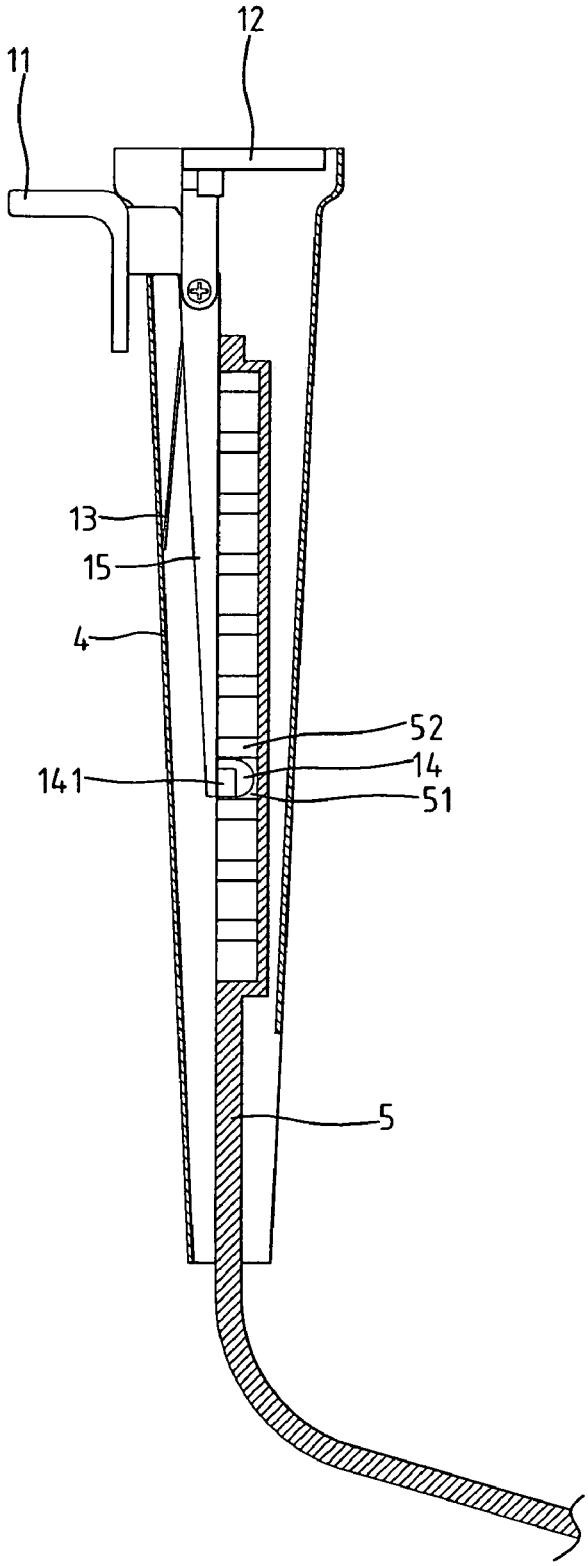
FIG. 11 is a plan view of the elevation device.

With reference to FIGS. 2, 10 and 11, the elevation device 1 of the present invention is composed of a hollow column 4 with two openings respectively defined in two opposite ends of the column 4, a substantially L-shaped support 5 and a first moving portion 11. The column 4 has a first cutout 41 defined in a top peripheral edge thereof to communicate with one of the two openings, two tracks 42 respectively defined in two opposite sides of the column 4, threaded holes 43 formed on a top face of the column 4 and through holes 44 each adjacent to one of the threaded holes 43. The support 5 is substantially L shaped and is divided into a vertical portion 50 adapted to connect to an armrest and a horizontal portion 54 adapted to connect to a seat of a chair. The vertical portion 50 is defined with multiple apertures 51, slits 52 each sandwiched between two adjacent apertures 51 to communicate the two adjacent apertures 51 and a second cutout 53 defined in a side face of the support 5 so as to receive therein a spring 55 having an arm 551 extending out therefrom. The first moving portion 11 is connected to a plate 15 having a protrusion 14 formed on a side face of the plate 15 to correspond to one of the slits 52 and provided with two wings 141 respectively extending from two opposite sides of the protrusion 14 to correspond to one of the apertures 51. The plate 15 is pivotally connected to a fixing seat 12 defining therethrough a long hole 120 and holes (not labeled) to correspond to the threaded holes 43 of the column 4. The fixing seat 12 has two ears 122 extending from a bottom face of the fixing seat 12 and respectively having an axle hole 1221 aligned with each other to allow an axle 123 to extend through the axle holes, a second spring 13 located between the two ears 122 and into a side face of the plate 15 so as to allow the fixing seat 12 to be pivotable relative to the plate 15. The plate 15 is abutted against the vertical portion 50 of the support 5 to allow the two wings 141 to be received in a corresponding one of the apertures 51. Thereafter, fixing seat 12 is securely mounted on top of the column 4 via screws threadingly extending through the holes of the fixing seat 12 and into the threaded holes 43 of the column 4. Then the combination of the plate 15 and the support 5 are inserted into the column 4 to allow the second spring 13 to abut an inner face of the column 4 and the arm 551 to abut an inner face defining the track 42 of the column 4 as shown in FIG. 11.

Figure 12:
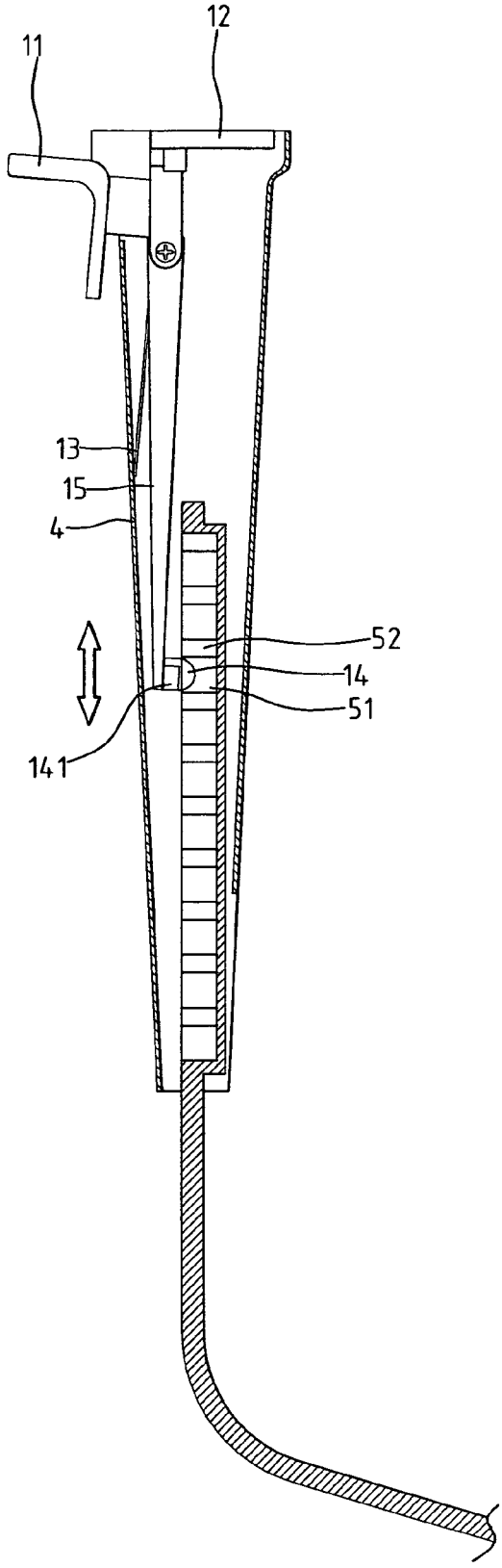
FIG. 12 is an operational view of the elevation device of the present invention.

With reference to FIG. 12, when the user moves the first moving portion 11, the two wings 141 are able to escape from the corresponding aperture 51, yet the protrusion 14 is still received in the corresponding slit 52. In the meantime, the user is able to move the column 4 relative to the support 5 to adjust the height of the armrest. After adjustment, the user releases the first moving portion 11 to allow the recoil force from the second spring 13 to push the plate 15 back to its original position such that the two wings 141 are received in a new corresponding aperture 51 of the support 5 to fix the support 4 relative to the support 5.

Figure 7A:
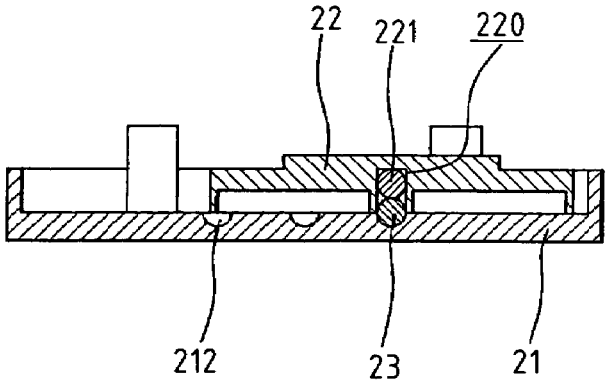
FIG. 7A is a schematic view in cross-section to show the first rocking device.
Figure 7B:
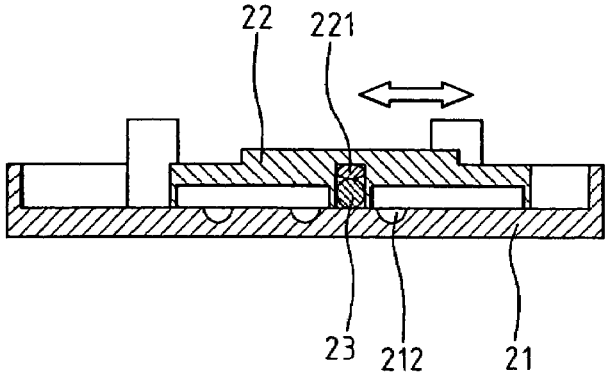
FIG. 7B is a schematic view in cross-section to show movement of the first rocking device.

With reference to FIGS. 2, 5, 6, 7A and 7B, the first rocking device 2 of the preset invention includes a base 21 and a moving plate 22. The base 21 has multiple laterally formed ribs 211, multiple recesses 212 defined in one of the ribs 211, multiple screw holes 213 and multiple laterally extending slits 214 defining through the base 21. The moving plate 22 is configured to be received in the base 21 and has a concave 220 defined in a bottom face of the moving plate 22 to sequentially receive therein an elastomer 221 and a pin 23 (as shown in FIG. 7A) to be selectively received in a corresponding one of the recesses 212. The elastomer 221 may be a rubber tube, a spring or the like. The moving plate 22 further has a centrally formed boss 201 and two protrusions 202 each oppositely formed relative to one another. Further, a substantially slender rocking plate 203 is attached to a top face of the moving plate 22. The rocking plate 203 has a central hole 2033 defined to correspond to the boss 201 of the moving plate 22, two securing holes 2034 each defined in a position opposite to each other, a sleeve 2036 extending from a bottom face defining the respective securing hole 2034, two wings 2031 respectively and oppositely formed relative to each other and each wing 2031 having multiple sectorially formed grooves 2032 defined in a bottom face of the wing 2031 to correspond to the respective protrusion 202 of the moving plate 22.

Figure 8:
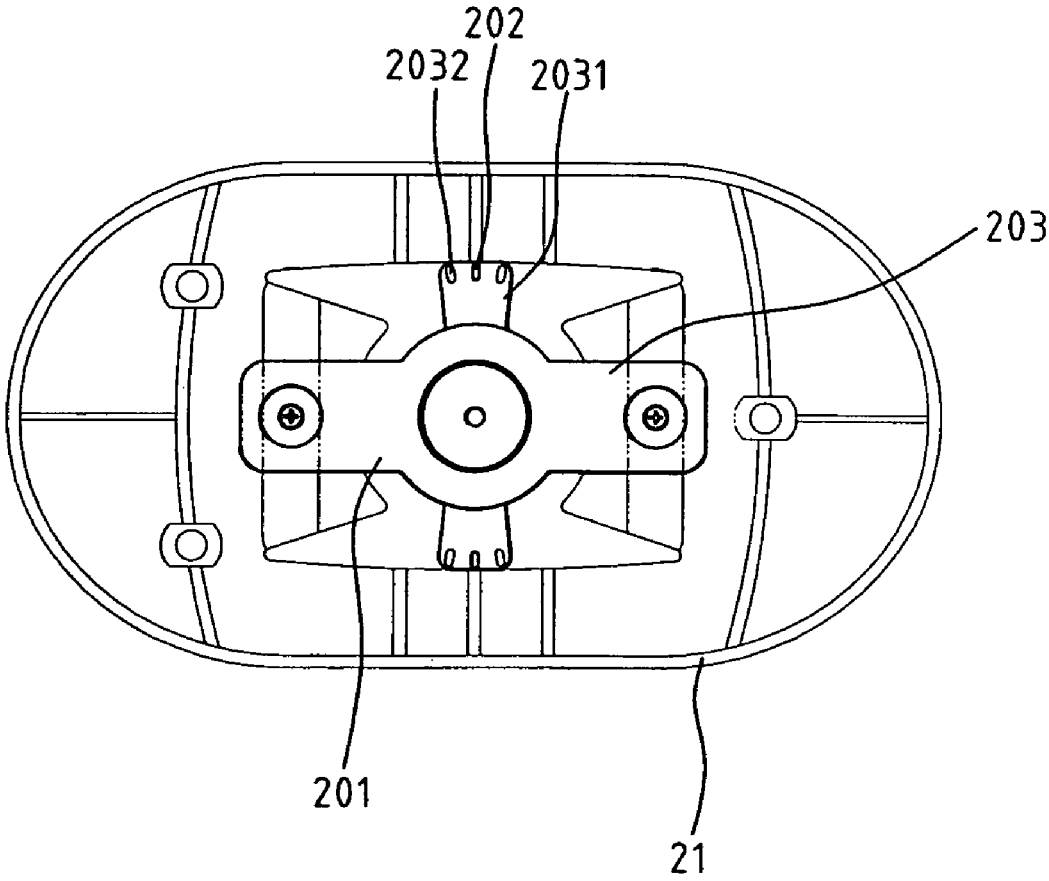
FIG. 8 is a plan view showing a second rocking device of the present invention.
Figure 9:
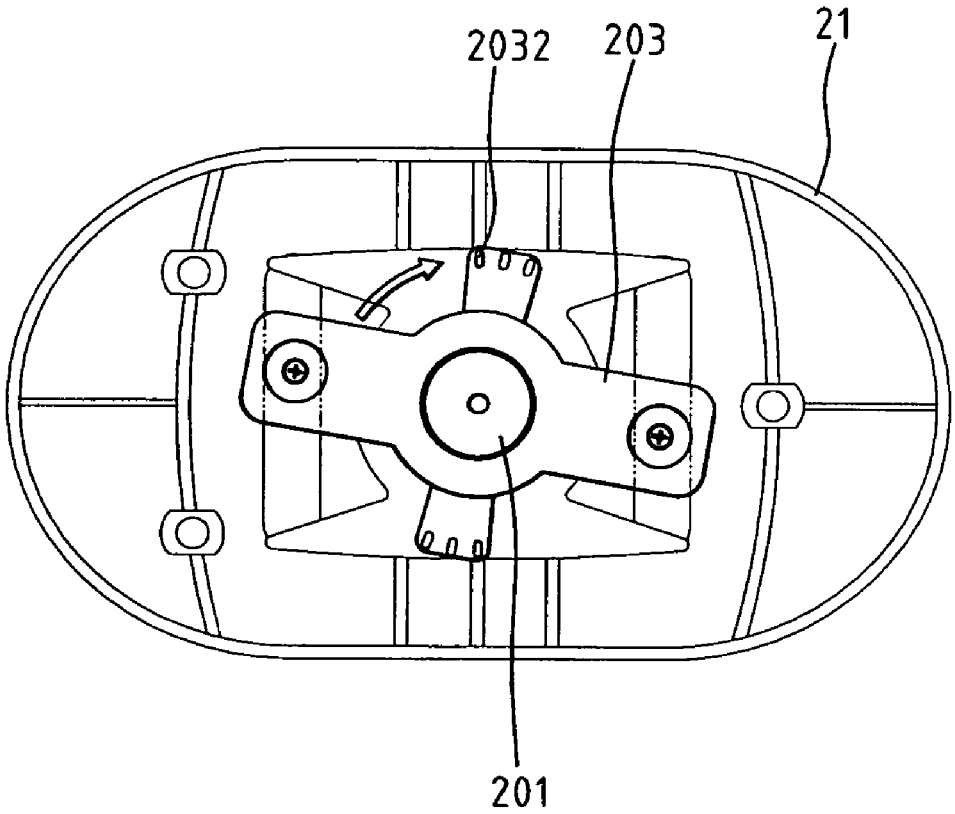
FIG. 9 is a schematic operational view of the second rocking device of the present invention.

With reference to FIGS. 2, 8 and 9, it is noted that after the base 21 and the moving plate 22 are assembled, the boss 201 of the moving plate 22 is received in the central hole 2033 of the rocking plate 203 and the sleeves 2036 are extended through the slits 214 of the base 21. Screws 2035 are employed to extend through the securing holes 2034 of the rocking plate 203, the screw holes 213 of the base 21 to secure the rocking plate 203 to the base 21 and into the threaded holes 43 of the column 4. Thus the moving plate 22 is securely sandwiched between the base 21 and the rocking plate 203. Therefore, when the base 21 is moved, due to the moving plate 22 being immovable, the movement of the base 21 will cause the rib 211 to force the pin 23 to compress the elastomer 221 until the pin 23 is received in a different recess 212. Thereafter, the recovery force from the elastomer 221 will position the pin 23 in that recess 212 such that the purpose of adjusting the base 21 to the left or to the right is achieved.

Furthermore, because the moving plate 22 is fixed relative to the base 21 due to the pin 23 of the moving plate 22 being positioned in the corresponding one of the recesses 212, movement of the base 21 will drive the moving plate 22 to move accordingly. Thus each of the protrusions 202 of the moving plate 22 is able to move among the grooves 2032 of each of the wings 2031 of the rocking plate 203 so that positioning effect of the movement of the base 21 is accomplished.

Figure 3:
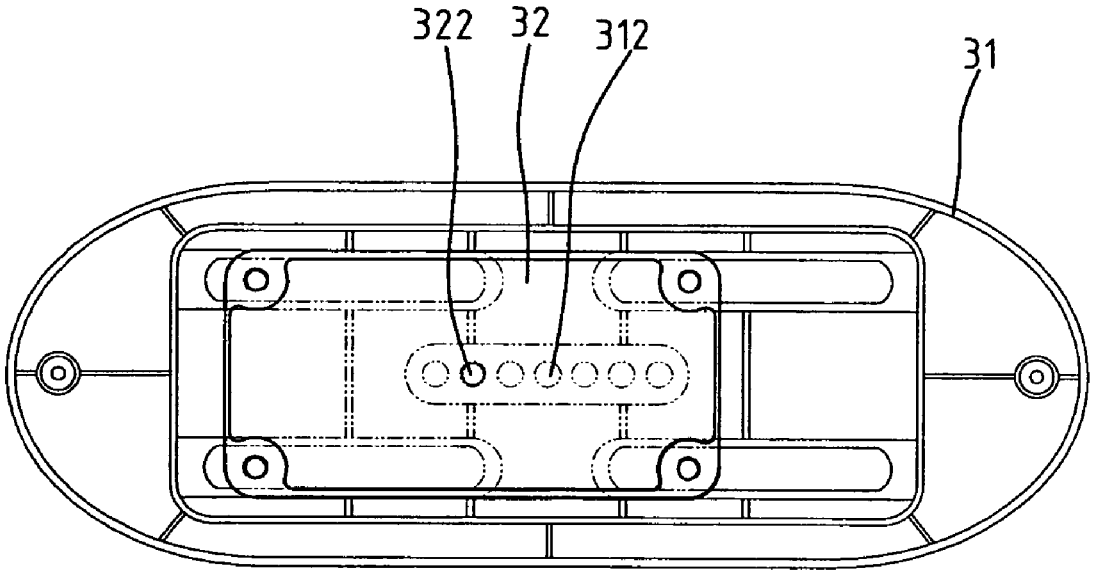
FIG. 3 is a schematic plan view showing a movement controlling device of the present invention.
Figure 4:
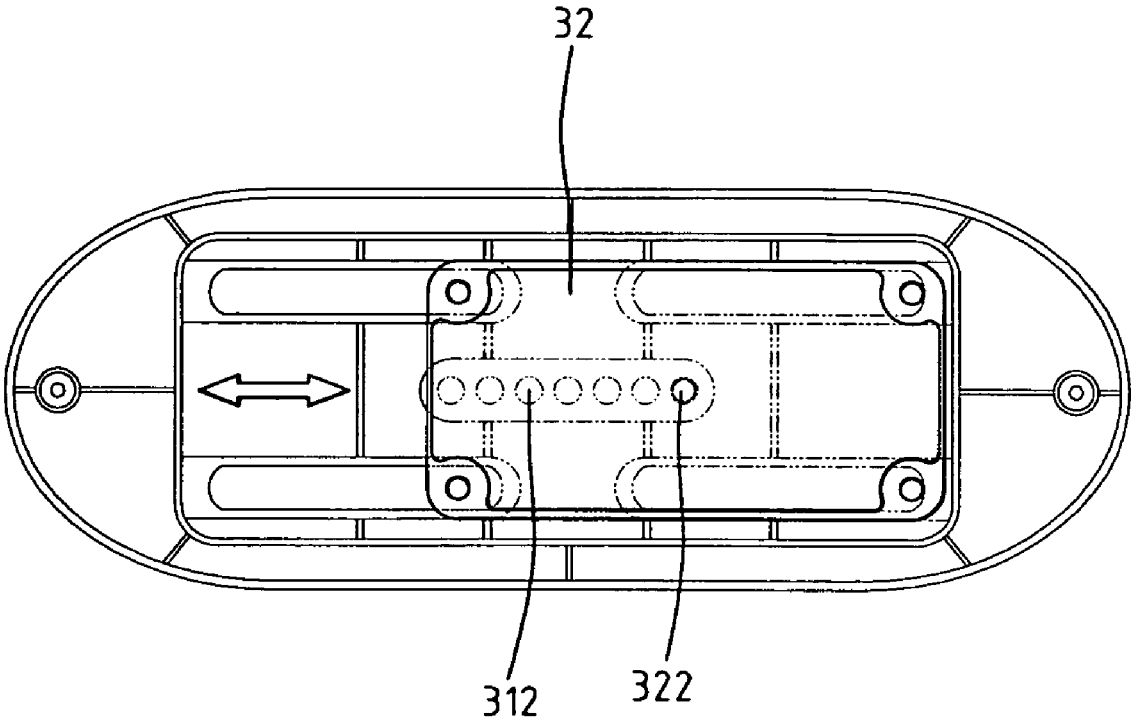
FIG. 4 is an operational plan view showing the operation of the movement controlling device of the present invention.
Figure 5:
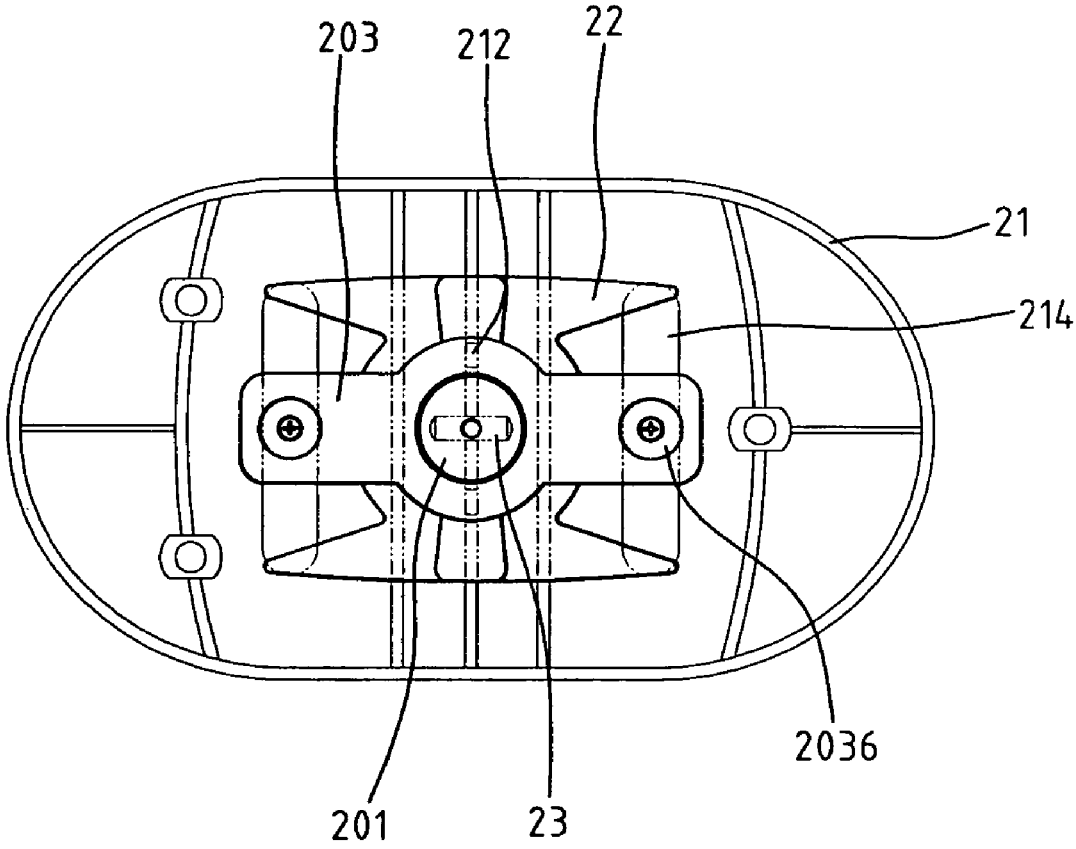
FIG. 5 is schematic plan view of a first rocking device of the present invention.
Figure 6:
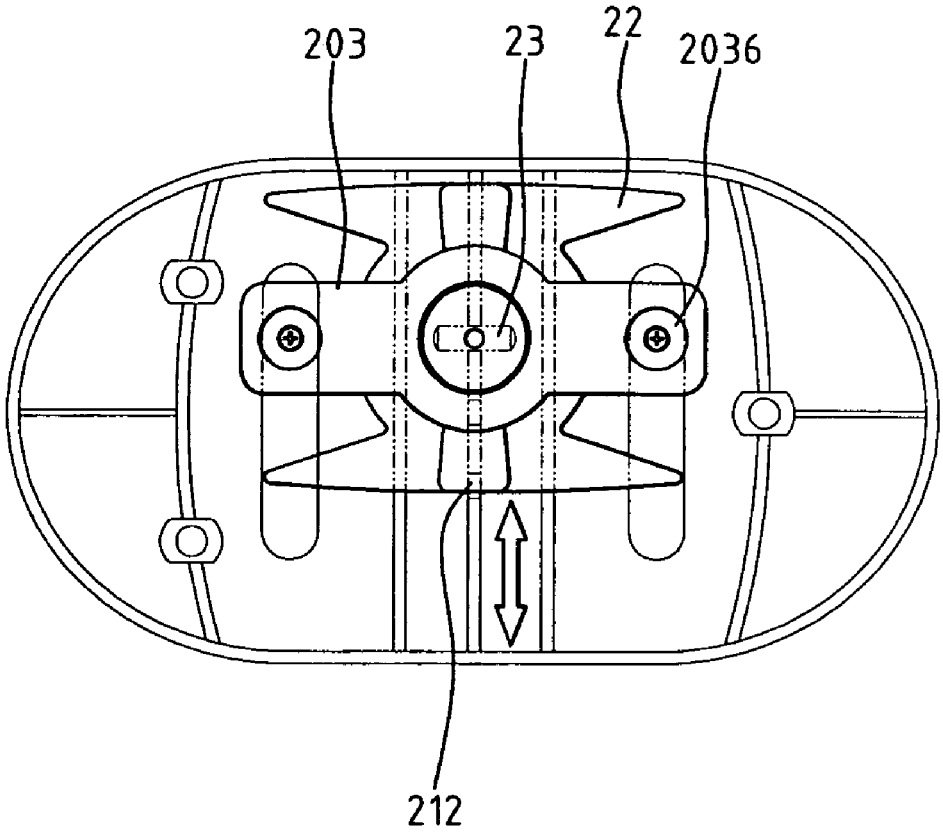
FIG. 6 is an operational plan view showing the operation of the first rocking device of the present invention.

With reference to FIGS. 2, 3, and 4, it is noted that the movement controlling device 3 of the present invention includes a substrate 31 and an elastic board 32. The substrate 31 is provided with multiple indents 312 and multiple elongated slots 311. The elastic board 32 has a head 322 formed on a bottom face of the elastic board 32 and multiple holes 321. When the substrate 31 and the elastic board 32 are assembled, screws 33 are employed to extend through the holes 321, the elongated slots 311 and into the screw holes 213 of the base 21 and the head 322 is received in a corresponding one of the indents 312 (as shown in FIG. 3). On top of the substrate 31, a hollow armrest cover 34 is provided to encase the elastic board 32. Under the situation where the base 21 and the elastic board 32 are fixed, movement of the substrate 31 is able to allow the head 322 to be received in a different corresponding one of the indents 312 to position the substrate 31 and the armrest cover 34, as shown in FIG. 4.

Figure 13:
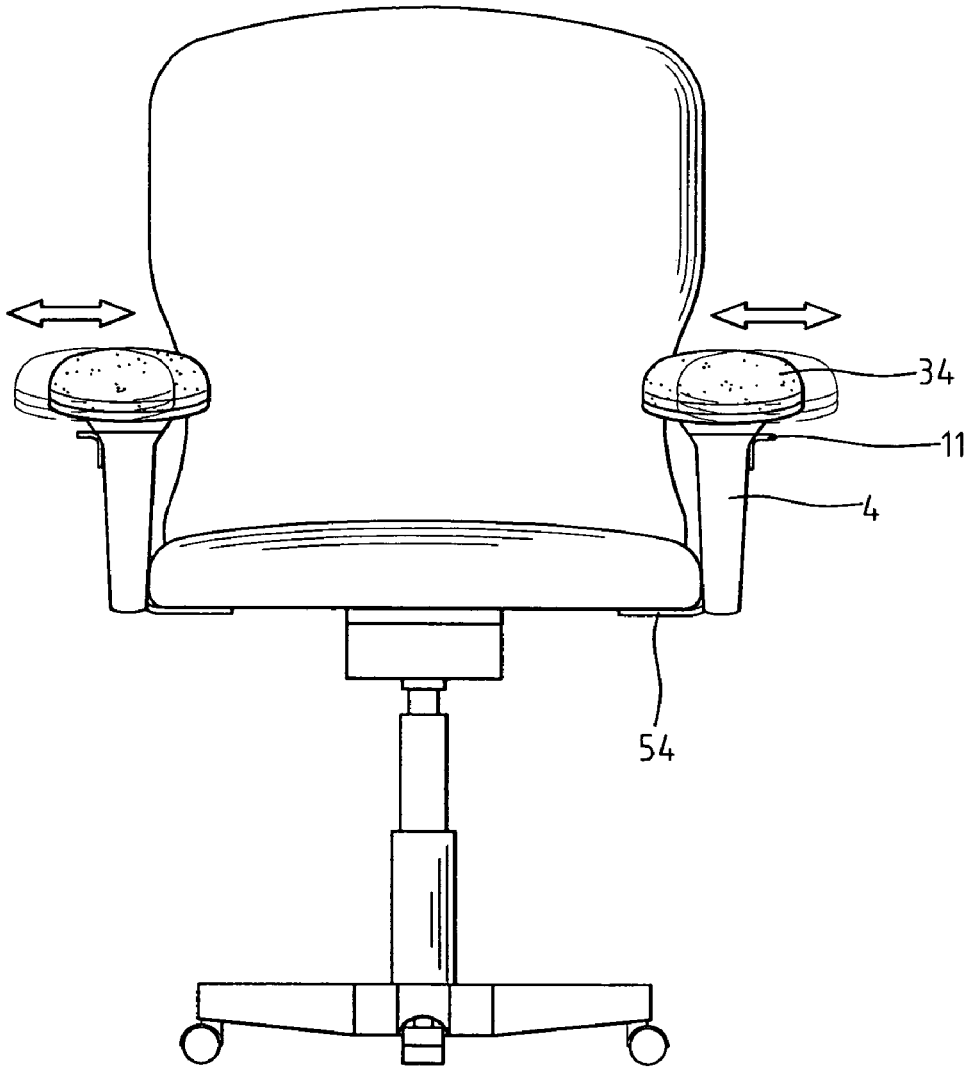
FIG. 13 is a schematic view showing the movement of the rocking device to adjust distance between the two armrests of a chair.
Figure 14:
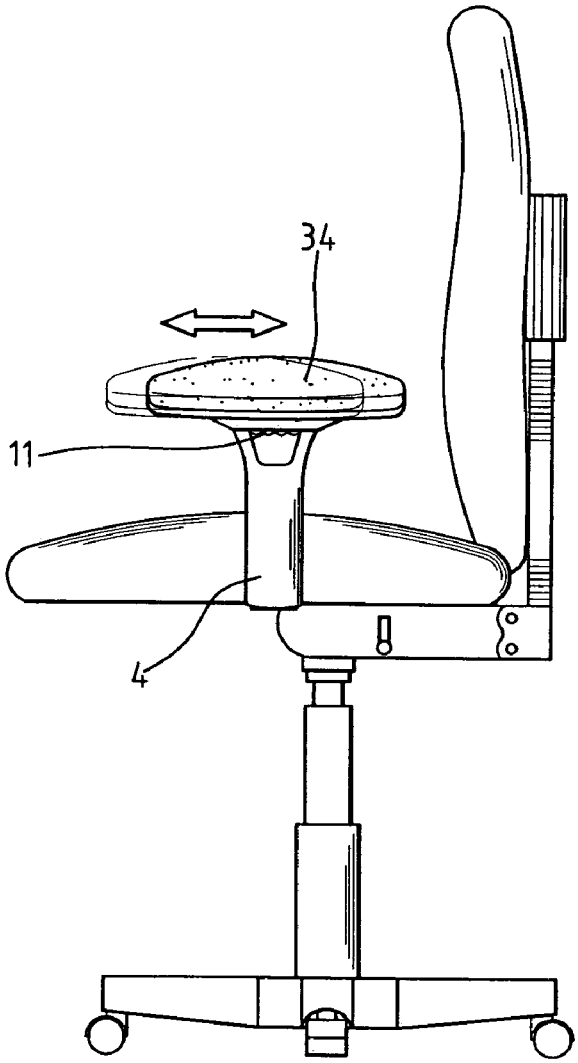
FIG. 14 is a schematic view showing the adjustment of the movement controlling device of the present invention.
Figure 15:
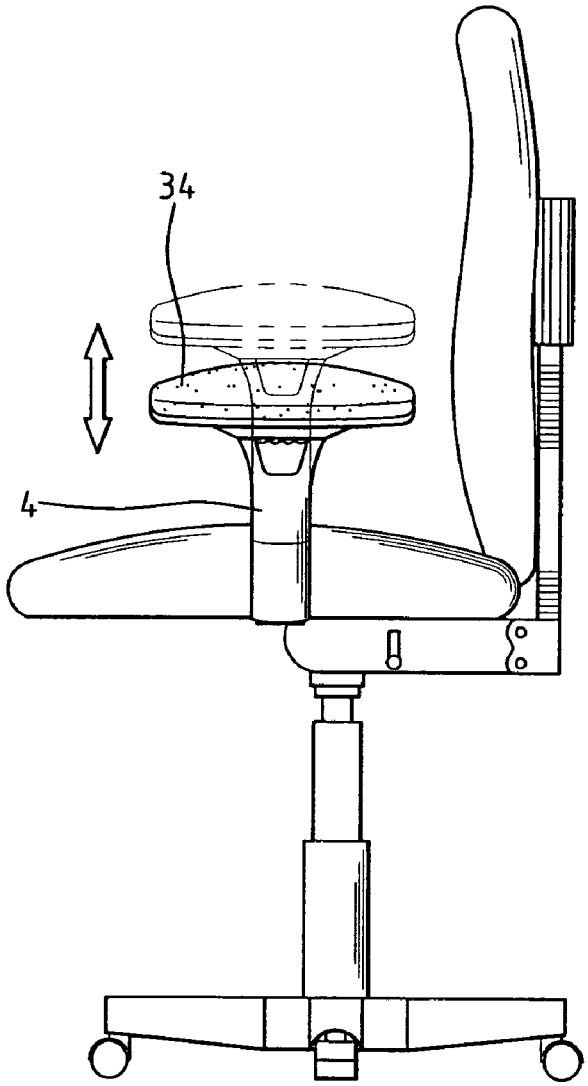
FIG. 15 is a schematic view showing the adjustment of the elevation device of the present invention.
Figure 16:
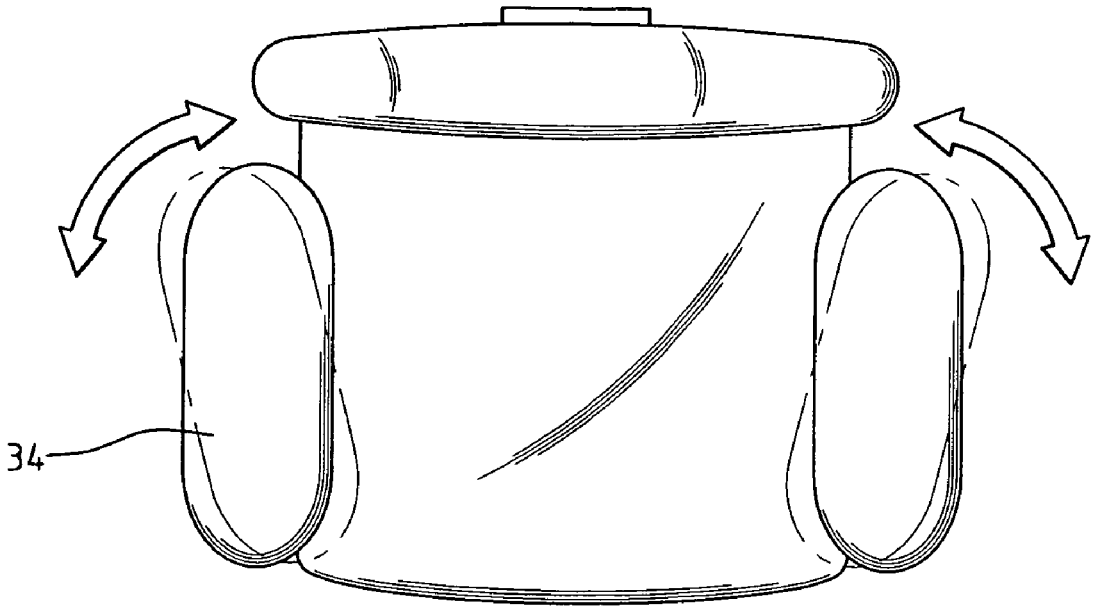
FIG. 16 is a schematic view showing the adjustment of the first rocking device of the present invention.

With reference to FIG. 13, the user is able to adjust a distance between two armrests, adjust extension length of the armrest as shown in FIG. 14 or to adjust a height of the armrest by moving the first moving portion 11 or to adjust the angle of the armrest as shown in FIG. 16.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable armrest comprising:

an elevation device having a hollow column with two openings respectively defined in two opposite ends of the column, a substantially L-shaped support and a first moving portion, wherein the column has a first cutout defined in a top peripheral edge thereof to communicate with one of the two openings, two tracks respectively defined in two opposite sides of the column, threaded holes formed on a top face of the column and through holes each adjacent to one of the threaded holes, the support is substantially L shaped and is divided into a vertical portion adapted to connect to an armrest and a horizontal portion adapted to connect to a seat of a chair, the vertical portion is defined with multiple apertures and slits each sandwiched between two adjacent apertures to communicate the two adjacent apertures, the first moving portion is connected to a plate having a protrusion formed on a side face of the plate to correspond to one of the slits and provided with two wings respectively extending from two opposite sides of the protrusion to correspond to one of the apertures, the plate is pivotally connected to a fixing seat defining therethrough a long hole and holes to correspond to the threaded holes of the column, the fixing seat has two ears extending from a bottom face of the fixing seat and respectively having an axle hole aligned with each other to allow an axle to extend through the axle holes, a first spring located between the two ears and into a side face of the plate so as to allow the fixing seat to be pivotable relative to the plate, the plate is abutted against the vertical portion of the support to allow the two wings to be received in a corresponding one of the apertures, such that after the fixing seat is securely mounted on top of the column via screws threadingly extending through the holes of the fixing seat and into the threaded holes of the column, then combination of the plate and the support are inserted into the column to allow the first spring to abut an inner face of the column, whereby movement of the first moving portion, the two wings are able to escape from the corresponding aperture, yet the protrusion is still received in the corresponding slit and then movement of the column relative to the support is able to adjust a height of the armrest, a first rocking device having a base and a moving plate, wherein the base has multiple laterally formed ribs, multiple recesses defined in one of the ribs, multiple screw holes and multiple laterally extending slits defining through the base, the moving plate is configured to be received in the base and has a concave defined in a bottom face of the moving plate to sequentially receive therein an elastomer and a pin to be selectively received in a corresponding one of the recesses, a centrally formed boss and two protrusions each oppositely formed relative to one another, a substantially slender rocking plate attached to a top face of the moving plate and having a central hole defined to correspond to the boss of the moving plate, two securing holes each defined in a position opposite to each other, a sleeve extending from a bottom face defining the respective securing hole, and two second wings respectively and oppositely formed relative to each other such that when the base and the moving plate are assembled, the boss of the moving plate is received in the central hole of the rocking plate and the sleeves are extended through the slits of the base, the rocking plate is secured to the base via screws which extend into the threaded holes of the column such that the moving plate is securely sandwiched between the base and the rocking plate and when the base is moved, due to the moving plate being immovable, the movement of the base will cause the rib to force the pin to compress the elastomer until the pin is received in a different recess, and a recovery force from the elastomer will position the pin in a different corresponding one of the recesses and purpose of adjusting the base is achieved, and movement of the base causes the protrusion of the moving plate to move among the grooves of each of the wings of the rocking plate so that positioning effect of the movement of the base is accomplished, and a movement controlling device having a substrate and an elastic board secured to the base, wherein the substrate is movable relative to the elastic board and provided with multiple indents and multiple elongated slots, the elastic board has a head formed on a bottom face of the elastic board to be selectively received in a corresponding one of indents of the substrate and multiple holes, such that movement of the substrate is able to allow the head to be received in a different corresponding one of the indents to position the substrate and the armrest cover.

2. The adjustable armrest as claimed in claim 1, wherein the support has a second cutout defined in a side face of the support so as to receive therein a spring having an arm extending out therefrom to abut an inner side face defining the track of the column.

3. The adjustable armrest as claimed in claim 2, wherein each second wing has multiple sectorially formed grooves defined in a bottom face of the wing to correspond to and selectively receive therein the respective protrusion of the moving plate.

4. The adjustable armrest as claimed in claim 3, wherein the elastomer is made of rubber.

5. The adjustable armrest as claimed in claim 4, wherein a hollow armrest cover is provided to encase the elastic board with the substrate.

6. The adjustable armrest as claimed in claim 3, wherein a hollow armrest cover is provided to encase the elastic board with the substrate.

7. The adjustable armrest as claimed in claim 2, wherein a hollow armrest cover is provided to encase the elastic board with the substrate.

8. The adjustable armrest as claimed in claim 1, wherein each second wing has multiple sectorially formed grooves defined in a bottom face of the wing to correspond to and selectively receive therein the respective protrusion of the moving plate.

9. The adjustable armrest as claimed in claim 8, wherein a hollow armrest cover is provided to encase the elastic board with the substrate.

10. The adjustable armrest as claimed in claim 1, wherein a hollow armrest cover is provided to encase the elastic board with the substrate.

* * * * *